US009457611B2

(12) United States Patent
Busam

(10) Patent No.: US 9,457,611 B2
(45) Date of Patent: Oct. 4, 2016

(54) EXPANDABLE CAPACITY POCKET DEVICE

(71) Applicant: ACCO Brands Corporation, Lake Zurich, IL (US)

(72) Inventor: Edward P. Busam, Mason, OH (US)

(73) Assignee: ACCO BRANDS CORPORATION, Lake Zurich, IL (US)

( * ) Notice: Subject to any disclaimer, the term of this patent is extended or adjusted under 35 U.S.C. 154(b) by 18 days.

(21) Appl. No.: 14/150,969

(22) Filed: Jan. 9, 2014

(65) Prior Publication Data

US 2014/0191021 A1 Jul. 10, 2014

Related U.S. Application Data

(60) Provisional application No. 61/750,563, filed on Jan. 9, 2013.

(51) Int. Cl.

| | |
|---|---|
| ***B65D 27/00*** | (2006.01) |
| ***B42F 7/02*** | (2006.01) |
| ***B42D 1/00*** | (2006.01) |
| ***B42D 1/06*** | (2006.01) |

(52) U.S. Cl.

CPC ..... *B42F 7/02* (2013.01); *B42D 1/007* (2013.01); *B42D 1/06* (2013.01)

(58) Field of Classification Search

CPC ..... B42F 7/06; B42F 7/02; B42F 11/00; B42F 13/00; B65D 27/08

USPC ..... 229/67.3, 67.1

See application file for complete search history.

(56) References Cited

U.S. PATENT DOCUMENTS

| | | | | |
|---|---|---|---|---|
| 91,728 | A * | 6/1869 | Eastman | 40/774 |
| 3,870,223 | A * | 3/1975 | Wyant | 229/72 |
| 4,420,112 | A * | 12/1983 | Cline | 229/72 |
| 4,934,584 | A * | 6/1990 | Wyant | 229/67.1 |
| 5,417,509 | A * | 5/1995 | Schwartz | 402/79 |
| 5,836,507 | A * | 11/1998 | Mueller et al. | 229/67.1 |
| 6,116,651 | A | 9/2000 | Makofsky et al. | |
| 6,666,610 | B1 | 12/2003 | Moor et al. | |
| 7,306,134 | B1 * | 12/2007 | Ong | 229/67.1 |
| 8,162,204 | B2 * | 4/2012 | Makofsky | 229/67.3 |
| 2004/0066031 | A1 * | 4/2004 | Wong et al. | 281/31 |
| 2008/0257940 | A1 | 10/2008 | Busam et al. | |
| 2009/0114704 | A1 * | 5/2009 | Howlett | 229/67.1 |
| 2013/0306715 | A1 * | 11/2013 | James et al. | 229/72 |
| 2013/0320074 | A1 * | 12/2013 | Leonard | 229/67.1 |
| 2014/0191020 | A1 * | 7/2014 | Busam | 229/67.1 |

* cited by examiner

*Primary Examiner* — Nathan J Newhouse
*Assistant Examiner* — Derek Battisti
(74) *Attorney, Agent, or Firm* — Thompson Hine LLP

(57) ABSTRACT

A pocket device including a major panel and a pocket panel coupled to the major panel and defining a pocket with the major panel. The pocket panel has a lateral dimension greater than a lateral dimension of the major panel at at least one position to thereby define a laterally-extending gap therebetween, which enables expansion of the pocket.

9 Claims, 19 Drawing Sheets

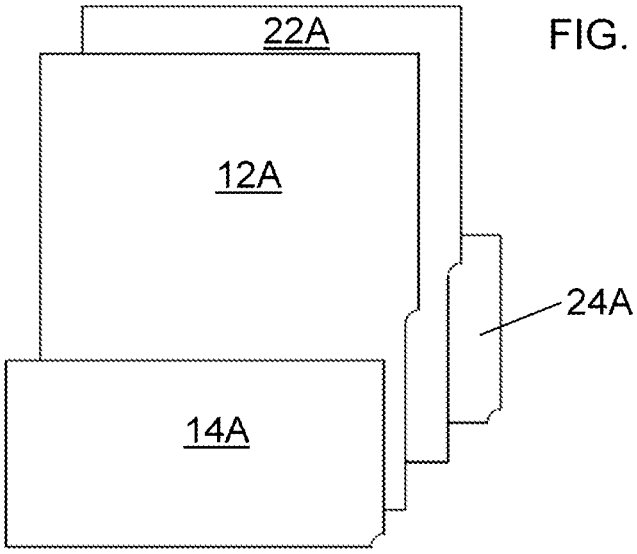
FIG. 7A
FIG. 7B
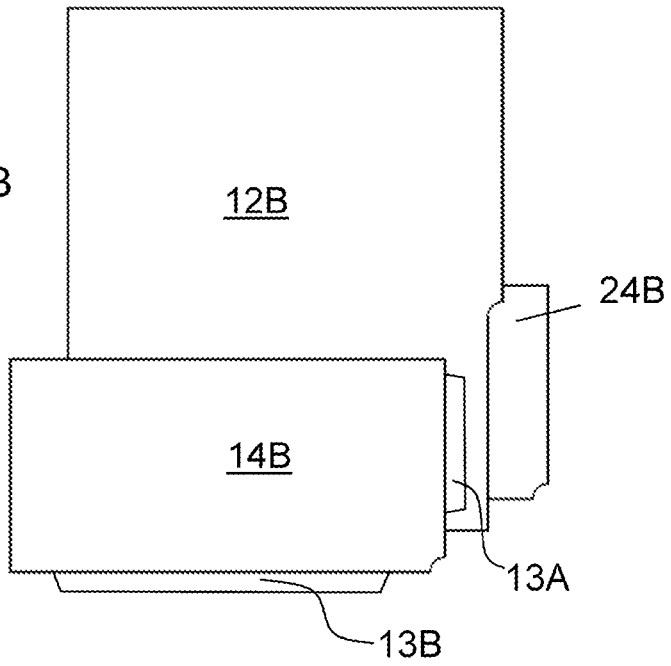

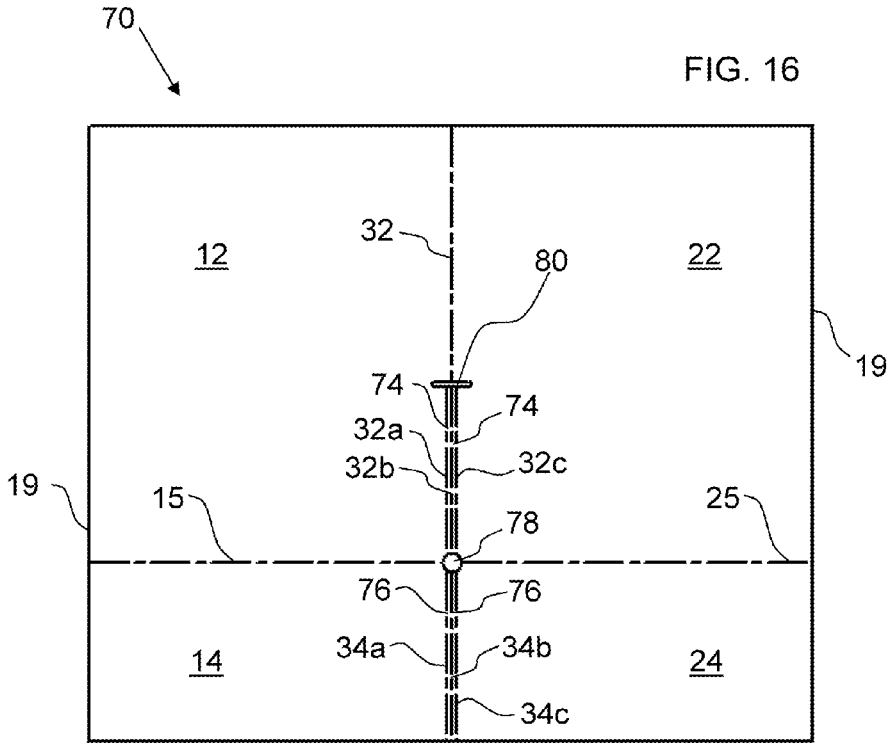
FIG. 16
FIG. 14C
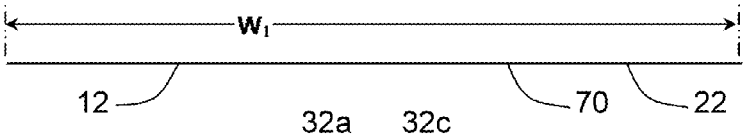
FIG. 14D
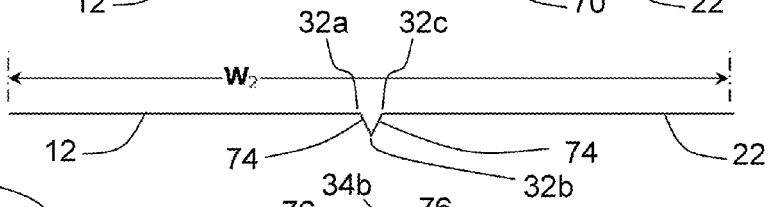
FIG. 14E
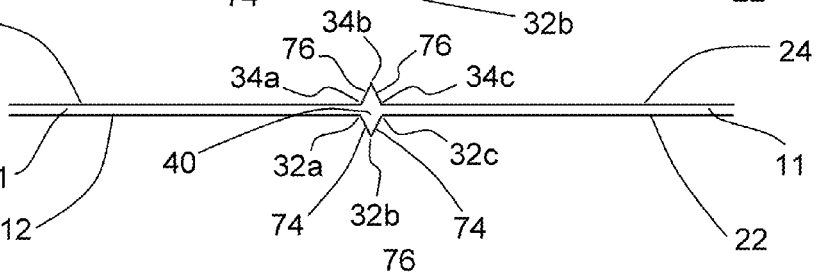

EXPANDABLE CAPACITY POCKET DEVICE

This application claims priority to U.S. Provisional Application Ser. No. 61/750,563 entitled EXPANDABLE CAPACITY POCKET DEVICE filed on Jan. 9, 2013, the entire contents of which are hereby incorporated by reference.

The present invention is directed to a pocket device, and more particularly, to a pocket device having an expandable capacity.

BACKGROUND

Pocket dividers or folders may be used to store various items such as loose papers, writing utensils, or the like. In many cases, the shape and configuration of the pocket divider may limit its storage capacity. The storage capacity can be particularly limited when the pocket of the pocket divider is bound on various sides, or is bound into a component such as a notebook.

SUMMARY

In one embodiment, the invention is a pocket device including a major panel and a pocket panel coupled to the major panel and defining a pocket with the major panel. The pocket panel has a lateral dimension greater than a lateral dimension of the major panel at at least one position to thereby define a laterally-extending gap therebetween, which enables expansion of the pocket.

BRIEF DESCRIPTION OF THE DRAWINGS

FIG. 4A is a top view of the pocket divider of FIG. 3A, with content items stored in the pocket;

FIGS. 7A and 7B are front exploded views of various blanks that can be used to make pocket dividers;

FIGS. 14C, 14D and 14E are cross sections taken along the lines indicated in FIGS. 14A and 14B;

FIG. 16 is a top view of a blank that can be used to form a pocket divider;

DETAILED DESCRIPTION

Figure 13:
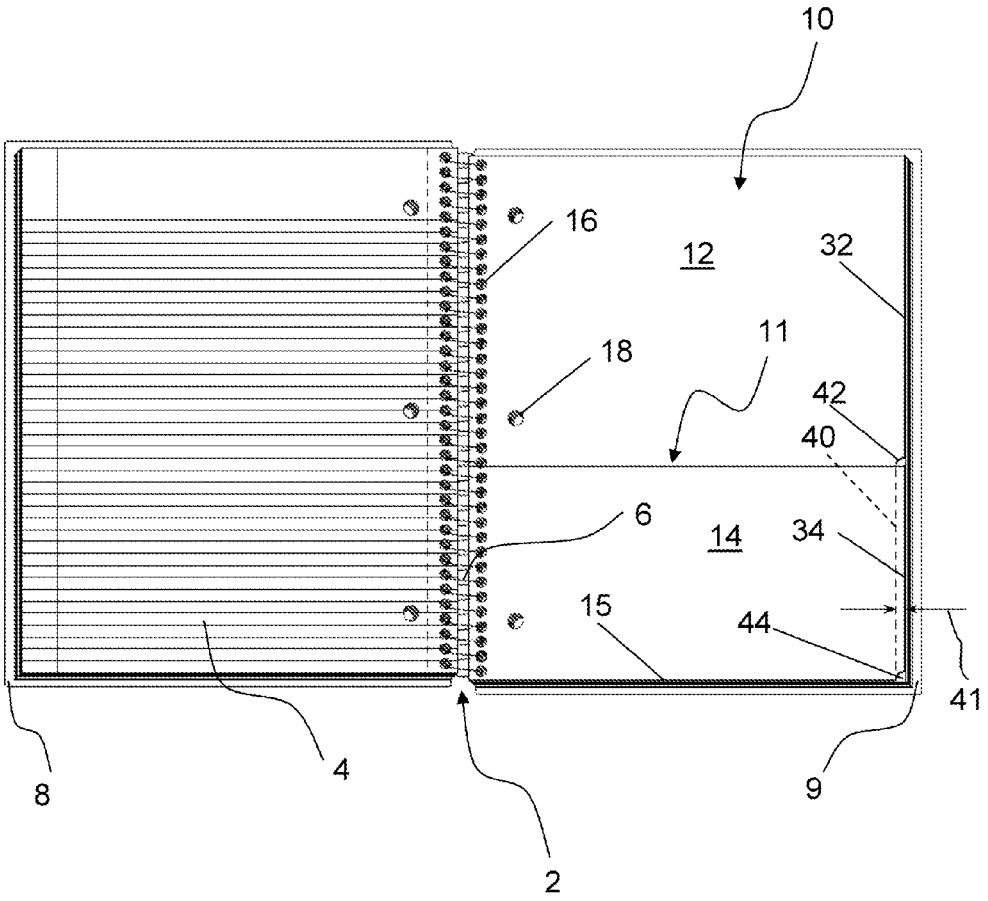
FIG. 13 is a top view of a notebook incorporating the pocket divider of FIG. 3A.

As shown in FIG. 13, a pocket/pocket divider 10 can be part of, or used in conjunction with, a notebook, generally designated 2. In one embodiment the notebook 2 includes a set of papers 4 bound together by a binding mechanism 6, such as a coil binding mechanism, a spiral binding mechanism, twin-wire binding mechanism, adhesive bindings, sewn or stapled binding mechanism and the like. The papers 4 may be made of cellulose based or pulp based paper or the like that can easily be written upon by a variety of marking instruments, such as pens, pencils, markers, etc. The notebook 2 can include a front cover 8 and a back cover 9 that are bound to the papers 4 by the binding mechanism 6. The notebook 2 can include one or more pocket dividers 10 spaced throughout the thickness of the notebook 2/papers 4.

Each pocket divider 10 can operate as a divider to segregate various portions of the notebook 2/papers 4 for ease of access and use. Each pocket divider 10 may have the same footprint/outer dimensions as other bound contents, such as the papers 4 and/or covers 8, 9. Alternately, the pocket divider 10 may protrude in any direction in the plane of the pocket divider 10, and/or be recessed in any direction in the plane, to provide a tactile separator function to the user. Each pocket divider 10 can include one or more pockets 11 to store loose items therein.

Figure 1:
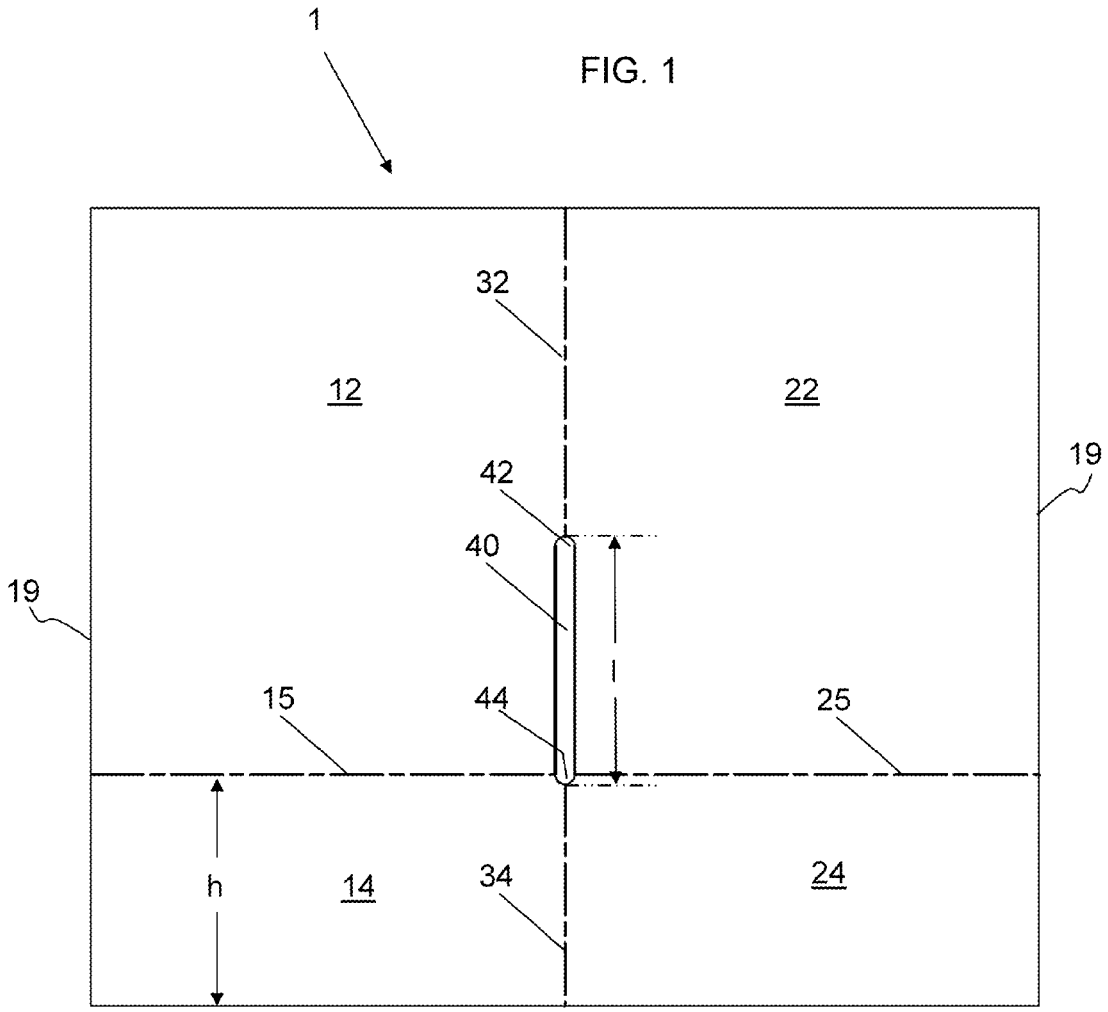
FIG. 1 is a top view of a blank that can be used to form a pocket divider.

Each pocket divider 10 can be made from a blank such as the blank 1 shown in FIG. 1. The blank 1 may be made of a relatively thin sheet material that is generally rectangular in shape, and includes a first or front major panel 12, a first or front pocket panel 14, a second, supplemental or back major panel 22, and a second, supplemental or back pocket panel 24.

The blank 1 includes a horizontally extending front pocket fold line 15 that separates the front major panel 12 and the front pocket panel 14. Blank 1 also includes a horizontally extending back pocket fold line 25 that separates the back major panel 22 and the back pocket panel 24. The blank 1 further includes a first or major vertical fold line 32 extending between and separating the front major panel 12 and back major panel 22. Finally, blank 1 includes a second or minor or pocket vertical fold line 34 extending between and separating the front pocket panel 14 and back pocket panel 24.

In the blank 1 the horizontal fold lines 15, 25 are collinear and may be considered a single fold line; however once the pocket divider 10 is formed the fold lines 15, 25 may appear more distinct. Similarly the vertical fold lines 32, 34 in blank 1 are collinear and may be considered a single fold line but may become more distinct when the pocket divider 10 is formed.

The blank 1/pocket divider 10 (i.e. including major panels 12, 22 and pocket panels 14, 24) can be made of any of a wide variety of materials, including but not limited to plastic or polymers (such as polypropylene or vinyl), cardboard, paperboard, plastic encased cardboard, etc. It should be noted that the fold lines 15, 25, 32, 34 can be formed as creases or areas of weakness in the blank 1. However, the fold lines 15, 25, 32, 34 need not necessarily be physically present in the blank 1, and can merely be imaginary lines about which the blank 1 is later folded.

The blank 1 may include a cutout or relief cutout 40 positioned along, and removing a part of, a lower portion of the major vertical fold line 32 (also removing part of the major panel 12 and/or 22). In the illustrated embodiment the cutout 40 includes an upper portion 42 positioned above the horizontal/pocket fold lines 15, 25, and also includes a lower portion 44 positioned below the horizontal pocket/fold lines 15, 25 such that lower portion 44 of the cutout 40 is positioned along, and removes a part of, an upper portion of the minor vertical fold line 34 (and also portions of the horizontal fold lines 15, 25). For reasons which will later become apparent, the cutout 40 may in some cases have a length 1 equal to or greater than the height h of pocket panels 14, 24.

Figure 2:
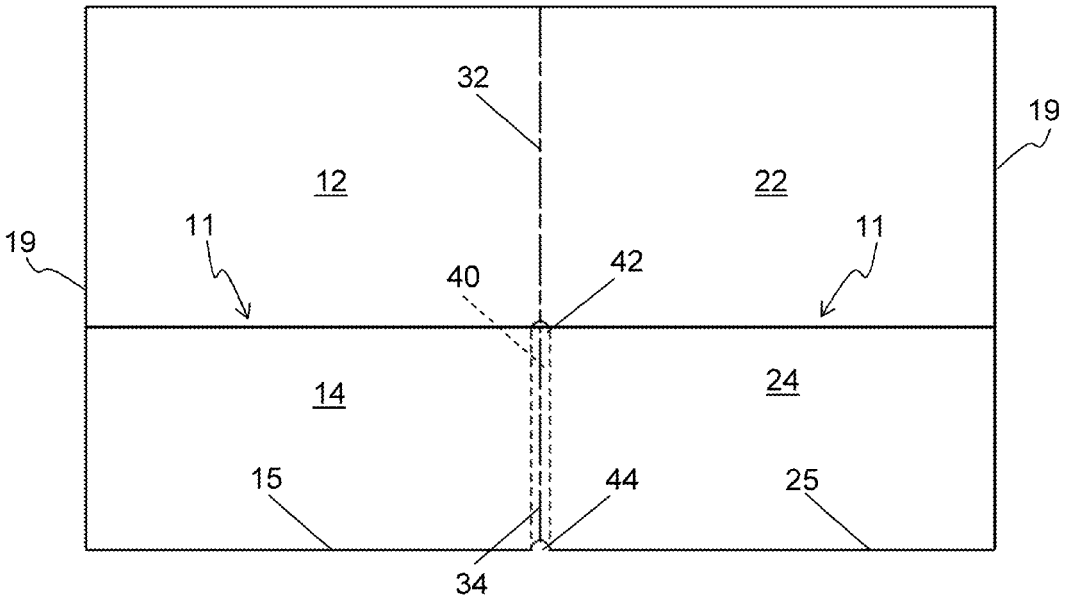
FIG. 2 is a top view of the blank of FIG. 1, with the pocket panels folded up.

As shown in FIG. 2, after the blank 1 of FIG. 1 is provided, the front pocket panel 14 and back pocket panel 24 can be folded upwardly about their associated horizontal fold lines 15, 25. After this folding step the front pocket panel 14 overlies, and forms a pocket 11 with, the front major panel 12, and back pocket panel 24 overlies, and forms a pocket 11 with, the back major panel 22. In one embodiment each pocket panel 14, 24 has a lesser height and/or surface area than the associated major panel 12, 22, such that each pocket 11 covers only part of the surface area of the associated major panel 12, 22.

Figure 3A:
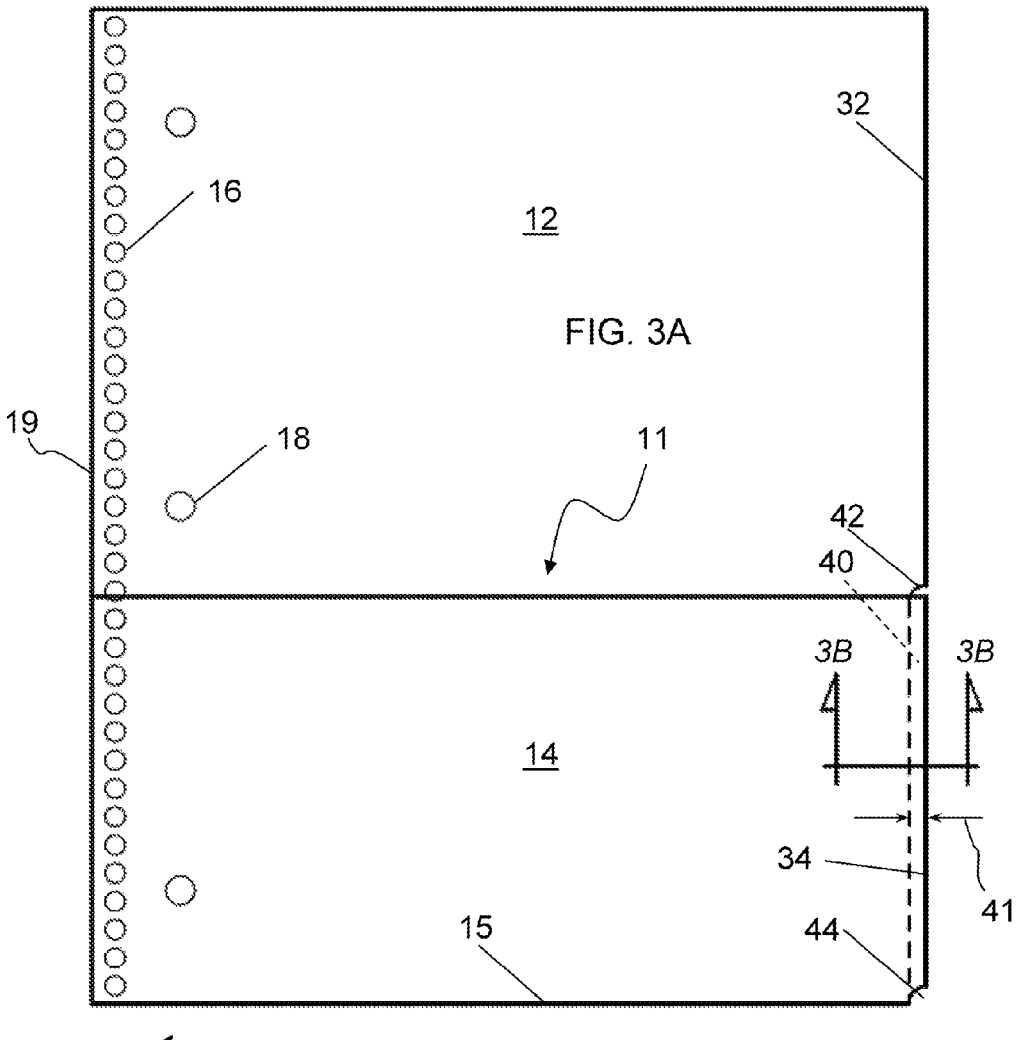
FIG. 3A is a top view of the blank of FIG. 2 folded about its centerline, forming the pocket divider, with various holes formed therethrough.

As shown in FIG. 3A, the blank 1 of FIG. 2 can then be folded outwardly along vertical fold lines 32, 34 causing the front major panels 12, 22 to be aligned and flush against each other. A plurality of coil binding holes 16 (if desired) and ring binding holes 18 (if desired) can then be formed along or adjacent to (but spaced apart from) the inner edges 19 of the blank 1/pocket divider 10. The coil binding holes 16 are spaced and configured to receive turns of a spiral or twin wire binding mechanism 6 therethrough, and the ring binding holes 18 are spaced and configured to receive the rings of a ring binder (such as a 3-ring binder with standard ring spacing, not shown) therethrough.

The coil binding holes 16 and ring binding holes 18 may be made at any stage in the forming/manufacturing process, including in the blank 1 before folding, or after making either of the folds along the fold lines 15/25 or 32/34, or even after assembling the pocket divider 10 into the binding mechanism 6 or other component. When the pocket divider 10 is assembled manually, it may not matter when the holes 16, 18 are formed. In contrast, when the pocket divider 10 is assembled by machine or automatically, it may be advantageous to create holes 16, 18 after pocket divider 10 has been folded into its position as shown in FIG. 3A, or after assembling a stack of materials to create a notebook 2 or the like, to ensure the holes 16, 18 are properly aligned.

The cutout 40 can be formed in a variety of manners. In one embodiment, the entire cutout 40, including its upper 42 and lower 44 portions, are simultaneously formed in the unfolded blank 1 as shown in FIG. 1. Alternately, the lower portion 44 of the cutout 40 can be formed at a different time from the upper portion 42. In particular, in one case upper portion 42 of the cutout is formed in the blank 1 as shown in FIG. 1, and the lower portion 44 of the cutout 40 (and/or a lower part of the upper portion 42) is formed in the partially assembled pocket divider in its state as shown in FIG. 2 (such as by making a semi-circular cut shown as lower portion 44 in FIG. 2), or in the pocket divider 10 as shown in FIG. 3A (such as by making a quarter-circular cut). As noted above, the inner edges 19 of the pocket divider 1 can be bound by a binding mechanism extending through the coiling binding holes 16 and/or ring binding holes 18. Alternately, or in addition, the inner edges 19 of major panels 12, 22 may be bound by glue, stitching, stapling, or other methods, or may be left unbound.

Figure 3B:
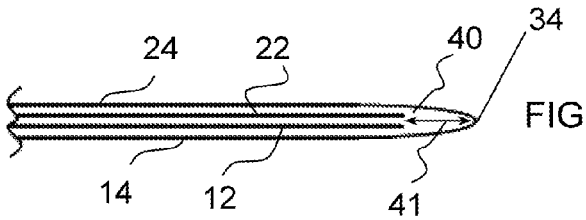
FIG. 3B is a cross section taken along the line indicated in FIG. 3A.

After the pocket divider 1 is assembled, the fold line 34 is aligned with and positioned adjacent to the cutout 40. In particular, when the pocket divider 10 is not full, the cutout 40 defines a laterally extending gap 41 between the outer edges of the major panels 12/22 and fold line 34/outer edges of the pocket panels 14/24, as shown in FIG. 3B. Since the outer portions of the major panels 12, 22 interior to the pocket 11 have been removed by the cutout 40, the lower portions of the major panels 12, 22 do not extend as far outward (i.e. to the right in FIG. 3B) compared to the pocket panels 14, 24. Thus the pocket panels 14, 24 may each have a greater lateral dimension than the major panels 12, 22. Stated differently, each pocket panel 14, 24 can include an extension portion extending laterally beyond the major panels 12, 22. The gap 41 can extend in a direction generally parallel to a mouth of the pocket 11 (e.g. in the lateral direction), and/or generally perpendicular to the binding mechanism 6.

Figure 4B:
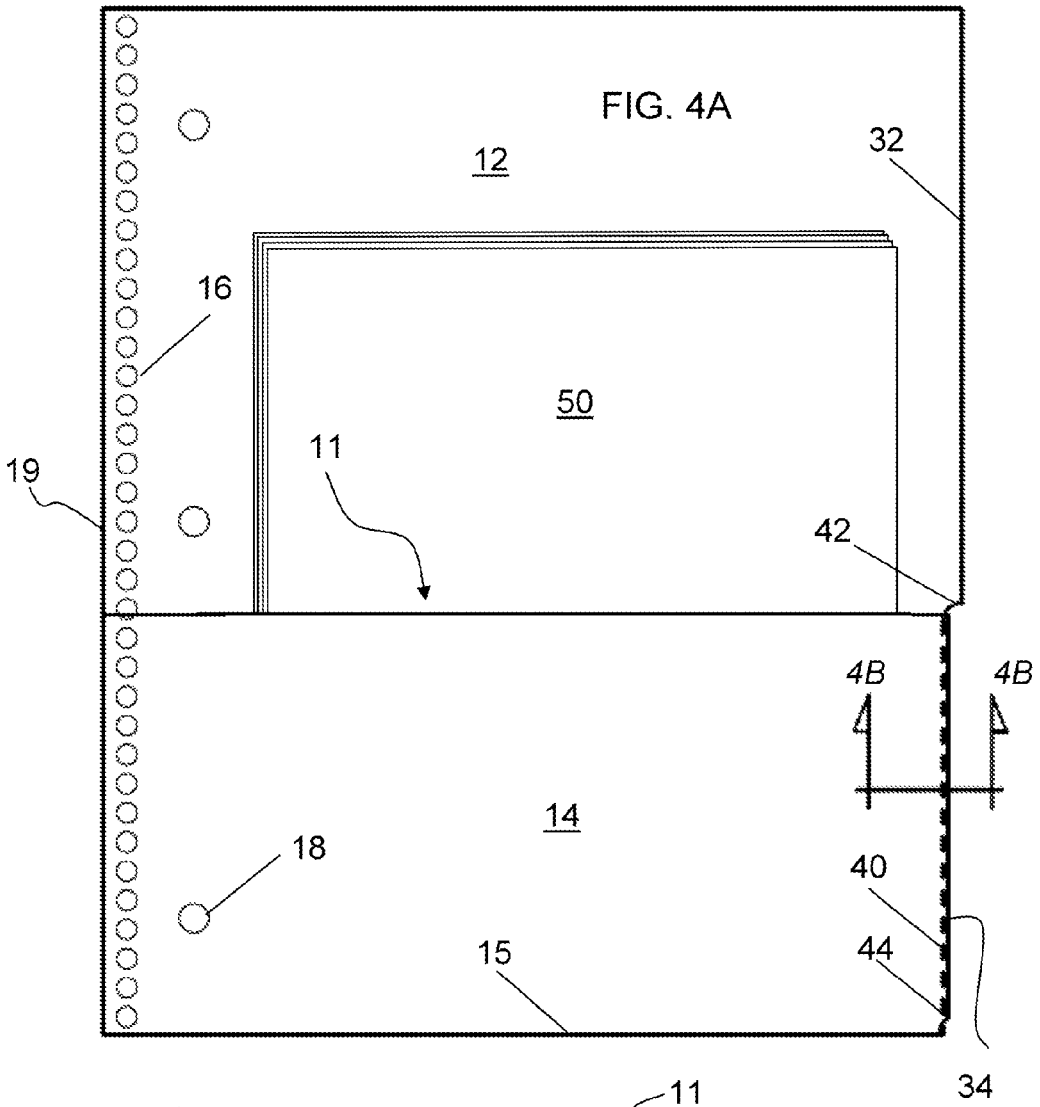
FIG. 4B is a cross section taken along the line indicated in FIG. 4A.

This configuration, and in particular the presence and positioning of the gap 41, provides increased expansion capability to the pockets 11. In particular, FIG. 4A illustrates the pocket 11 of FIG. 3B in an expanded position with contents, such as a stack of papers 50, positioned therein. As can be seen, when the volume of the pocket 11 increases, the fold line 34 may be pulled inwardly (to the left in FIGS. 3A, 3B, 4A and 4B), thereby allowing the pocket 11 to expand. In this manner, lateral movement of the pocket panels 14/24 enables the perpendicular distance between the pocket panels 14/24 and associated major panels 12/22 to increase, thereby increasing the storage capacity of the pockets 11. As can be seen in FIG. 4B, the pocket 11 may be able to expand such that the gap 41 is eliminated, and the fold line 34 (or immediately adjacent areas) engages the inner edge of the main panels 12, 22. Once the contents 50 of the pocket 11 are removed, the pocket 11 can return to its compact/flat/low profile shape, as shown in FIGS. 3A and 3B.

Figure 5:
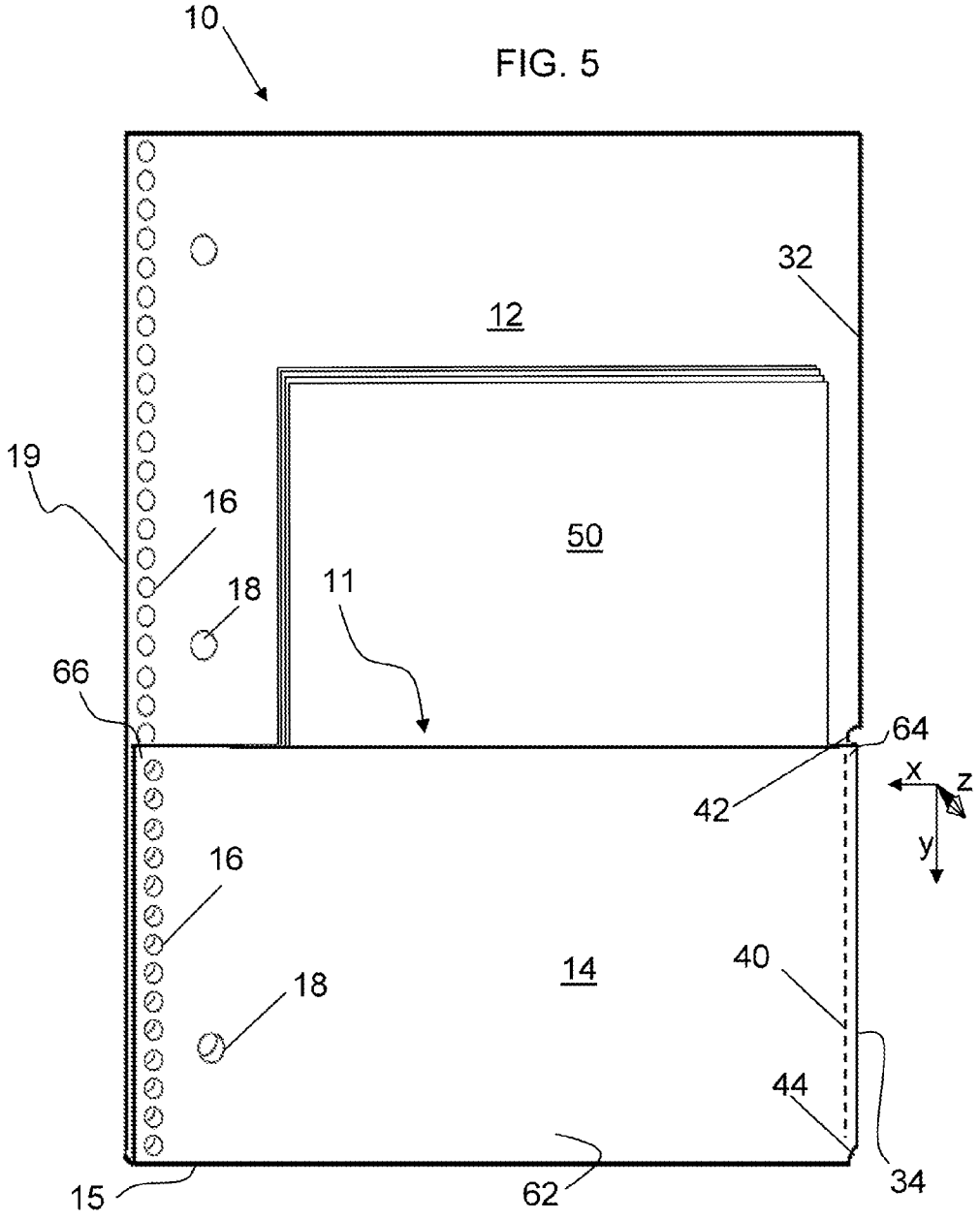
FIG. 5 is a perspective view of the pocket divider of FIG. 4A illustrating certain movement of the pocket when content items are placed therein.

FIG. 5 is a perspective view of the pocket divider 10 illustrating some of the movement that may occur as pocket 11 expands to accommodate content items 50. At position 62, located along or adjacent to the lower edge 15 of the pocket divider 10, the pocket panel 14 may move outwardly/forwardly in the z direction during expansion to provide additional capacity. The pocket panel 14 may be made of materials that are generally or relatively inelastic. Thus, in order for the panel 14 to move in the z direction, the pocket panel 14 may, as a whole, move downward slightly in the y direction. Assuming equal expansion of both the front and back pockets 11, the movement of the lower edge 15 of each pocket divider may be limited to approximately the radius of the opening 44 at the lower end of cutout 40.

At position 64, located along or adjacent to the upper outer edge of the pocket 11 adjacent to the vertical fold 34, upon expansion of the pocket 11, the panel 14 may move outwardly/forwardly in the z direction to provide increased capacity. To accommodate such movement in the z direction, the pocket panel 14 may move laterally inwardly/leftwardly in the −x direction at position 64. As noted above, such movement in the x direction is permitted by the cutout 40 and limited by the size of the gap 41.

At position 66, located along or adjacent to the upper inner edge 19 of the pocket 11, during expansion the panel 14 may move outwardly/forwardly in the z direction and also move laterally/rightward in the x direction. Such lateral movement may be limited by engagement of a binding hole 16 with the binding mechanism 6 (such as a wire coil passing through holes 16). However, the binding holes 16 are typically larger than the wire received thereon, so that some lateral movement is permitted although binding holes 16, 18 in the pocket panel 14 may move out of precise alignment with binding holes 16 in the major panel 12, as shown in FIG. 5. Likewise the binding holes 18 are typically larger than the rings of a binder to permit movement in a similar manner.

Figure 6:
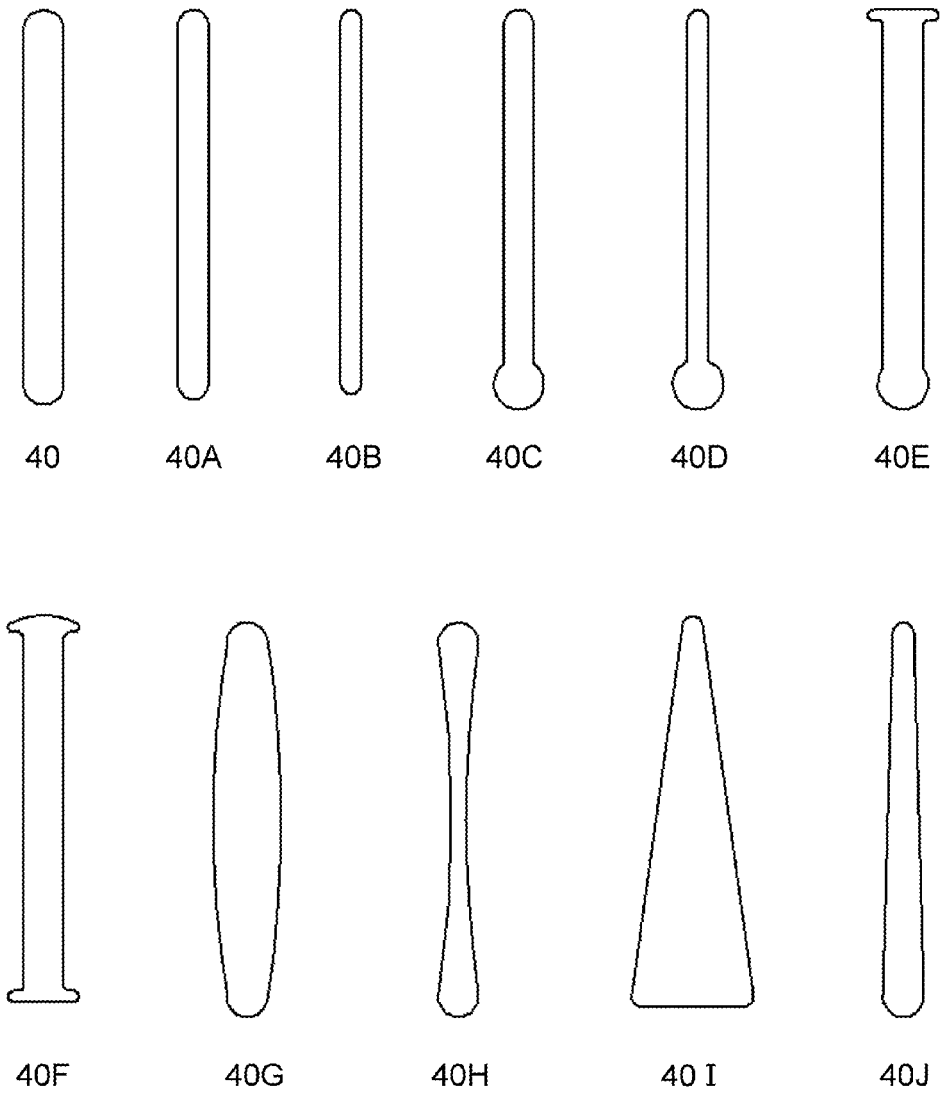
FIG. 6 is a plan view of various cutouts that can be used in a pocket divider.

The cutout 40 can have various sizes, shapes and dimensions when formed in the blank 1 of FIG. 1, besides the oval shape, some shapes of which are shown in FIG. 6. In one case, for example, the cutout 40 and/or gap 41 may have a lateral width of at least about 1/16", or at least about 1/8," or at least about 3/8" to provide sufficient expansion capabilities although the width can be greater or less as desired. In one case the cutout 40 can have a lateral width less than about 10%, or less than about 5% of the lateral width of the blank 1/pocket divider 10, so that the pocket divider 10 retains sufficient structural integrity. The cutout 40 may also have a width greater than about 1%, or greater than about 2%, of the lateral width of the blank 1/pocket divider 10 so that the pocket divider 10 has sufficient expansion capabilities.

The lower portion 44 of the cutout 40 may be enlarged (i.e. have a lateral width greater than the majority of the cutout 40 or the body of the cutout 40) as shown for example in cutouts 40C, 40D, 40E and 40F of FIG. 6, which provides further expansion in the corners of the pockets 11, which can otherwise provide a pinch/constraining point. The upper end 42 of the cutout 40 may also be enlarged as desired, for example as shown in cutouts 40E, 40F to enable greater expansion of the upper edge of the pocket 11.

A conventional pocket may hold about 25 sheets of material (depending on the size and thickness of the sheets), the dimensions of the pocket, etc. However, by providing the cutout 40, the outer edge of pocket 11 may move as outlined above to provide increased expansion of pocket 11. Therefore more contents may be added to pocket 11, for example about 45 sheets of materials (again, depending on the size and thickness of the sheets and the dimensions of the pocket), a capacity increase of about 80%. If the pockets 11 are equally loaded, such a cutout 40 may permit each pocket 11 to easily hold stack of contents 50 about 3/16" thick (e.g., half the width of the cutout 40 when the cutout 50 is 3/8" wide).

Figure 4B:
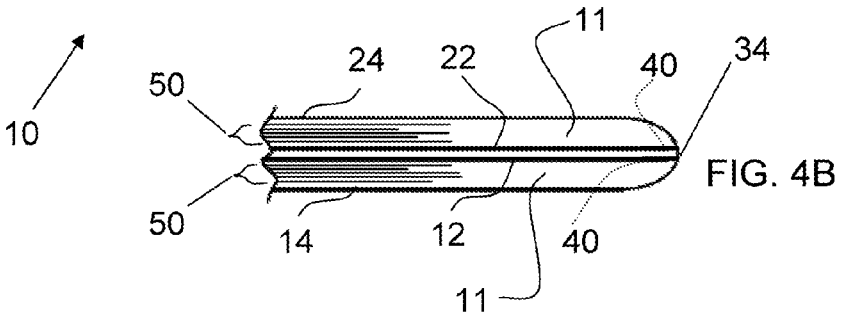

As outlined above, the pocket divider 10 may be bound into a binding mechanism 6 using coil binding holes 16 or into a ring binder using ring binder holes 18. Although the pocket divider 10 shown in FIGS. 3-5 has coil binding holes 16 and/or ring binding holes 18 located along the inner 19 (i.e. left) edge, it should be understood that binding holes 16, 18 and/or a binding mechanism may be provided along a different edge (not shown), for example along the top edge, right/outer edge 32/34, etc.

The pocket divider 10 may also or instead be used as a standalone device, not bound to any other component. In this case the inner edges 19 can be free/uncoupled. Alternately one or both pocket panels 14, 24 are secured to their associated major panel 12, 22 along the inner edges 19, and/or the major panels 12, 22 are secured together along their inner edges 19 or their inner faces, or all the panels 12, 14, 22, 24 are secured together along their inner edges 19. The panels 12, 14, 22, 24 (and other securing or coupling operations disclosed herein) can be adhered together along their inner edges by a variety of methods, such as heat welding, sonic welding, stitching, adhesives, staples, heat sealing, staples, rivets or other mechanical fasteners, etc. The divider pocket 10 may include only a single major panel if desired, and/or may have one a single pocket panel defining a single pocket 11, or utilize two pocket panels to define to pockets 11.

Instead of making the pocket divider from a single-piece blank as shown in FIG. 1, two or more separate pieces may be joined together to form a pocket divider, as shown in FIGS. 7-9. These assembly methods may define certain edges by joining separate pieces of material together along edges which may be folds in a single piece of material in the embodiment of FIG. 1.

FIG. 7A shows four separate pieces that can be used to make a pocket divider, including front pocket panel 14A, front major panel 12A, back major panel 22A, and back pocket panel 24A. FIG. 7B shows three separate pieces used to make the pocket divider, including only a single front pocket panel 14B, a single major panel 12B, and back pocket panel 24B. Certain panels may be joined together along certain edges to form the finished pocket divider. As an aid for securing the panels, certain panels may be provided with securing flaps, such as side flap 13A (FIG. 7B) for joining the outer or right side edges of pocket panels 14B, 24B. The front pocket panel 14B of FIG. 7B includes a bottom flap 13B for joining the lower edges of pocket panels 14B, 24B. Although securing flaps are not shown for many of the remaining or previous figures, it should be understood that such securing flaps may be included or omitted according to manufacturing preference.

Figure 8A:
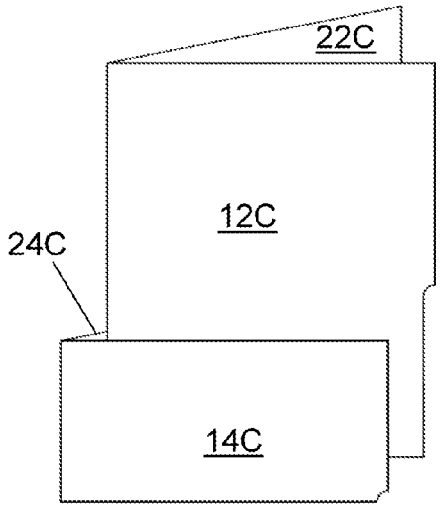
FIGS. 8A, 8B, 8C and 8D are front exploded views of various blanks that can be used to make pocket dividers.
Figure 8B:
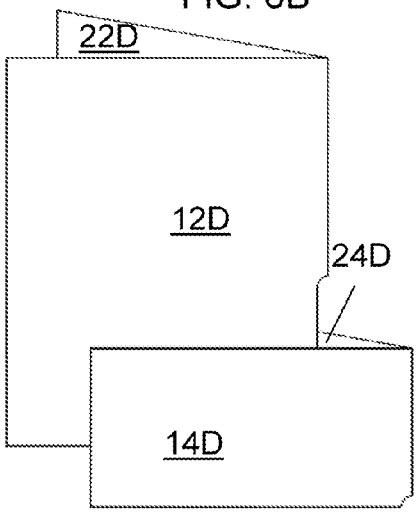
Figure 8C:
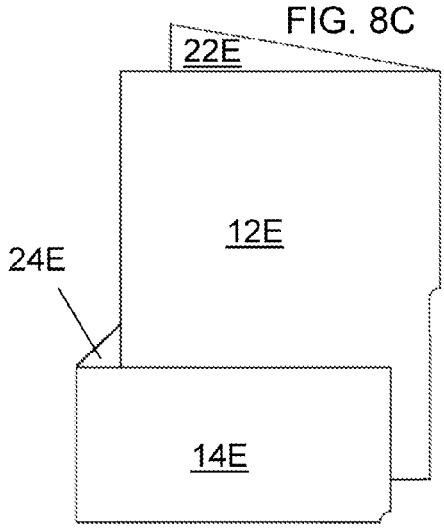
Figure 8D:
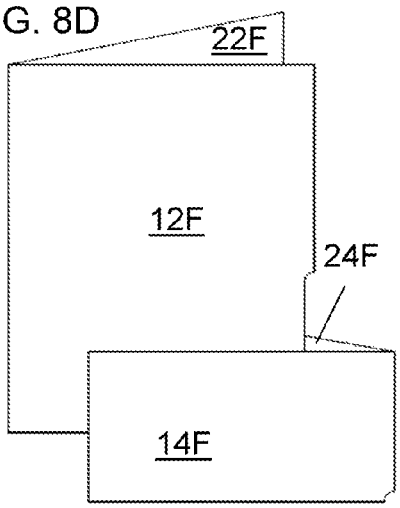

FIGS. 8A-8D show various combinations of two separate folded pieces that can be used to make a pocket divider, where the folds are positioned along side/outer edges. In FIG. 8A, front major panel 12C and back major panel 22C are joined by a fold along their inner or left edge, and front pocket panel 14C and back pocket panel 24C are joined by a fold along their inner/left edge. In FIG. 8B, front major panel 12D and back major panel 22D are joined by a fold along their outer or right edge, and front pocket panel 14D and back pocket panel 24D are joined by a fold along their outer or right edge. In FIG. 8C, front major panel 12E and back major panel 22E are joined by a fold along their outer or right edge, while front pocket panel 14E and back pocket panel 24E are joined by a fold along their inner or left edge. In FIG. 8D, front major panel 12F and back major panel 22F are joined by a fold along their inner or left edge, while front pocket panel 14F and back pocket panel 24F are joined by a fold along their outer or right edge.

Figure 9A:
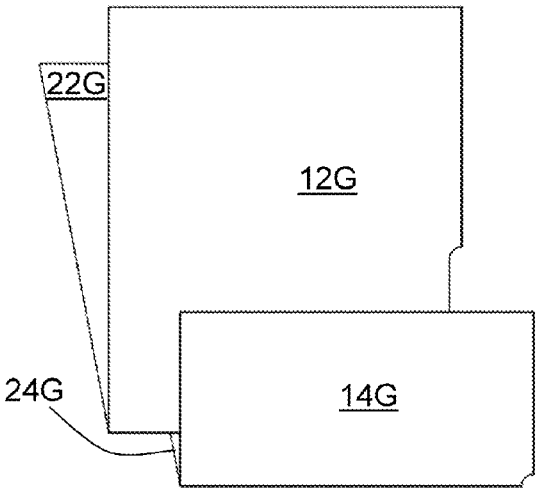
FIGS. 9A, 9B, 9C and 9D are front exploded views of various blanks that can be used to make pocket dividers.
Figure 9B:
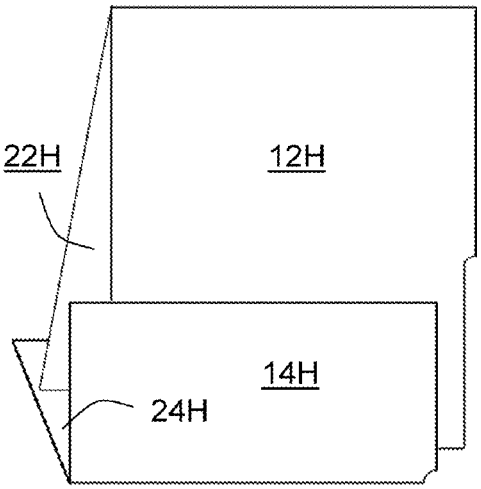
Figure 9C:
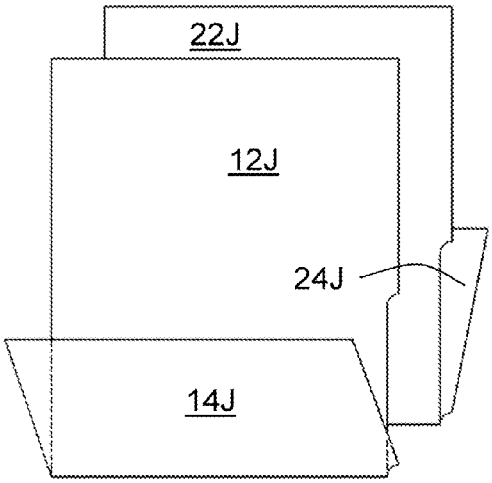

FIGS. 9A-9D illustrate various combinations of two separate folded pieces that can be used to make the pocket divider, where the folds occur along top or bottom edges. In FIG. 9A, front major panel 12G and back major panel 22G are joined by a fold along their lower edge, and front pocket panel 14G and back pocket panel 24G are joined by a fold along their lower edge. In FIG. 9B, front major panel 12H and back major panel 22H are joined by a fold along their top edge, while front pocket panel 14H and back pocket panel 24H are joined by a fold along their lower edges. In FIG. 9C, front major panel 12J and front pocket panel 14J are joined by a fold along their lower edge, and back pocket panel 22J and back pocket panel 24J are joined by a fold along their lower edge.

Figure 9D:
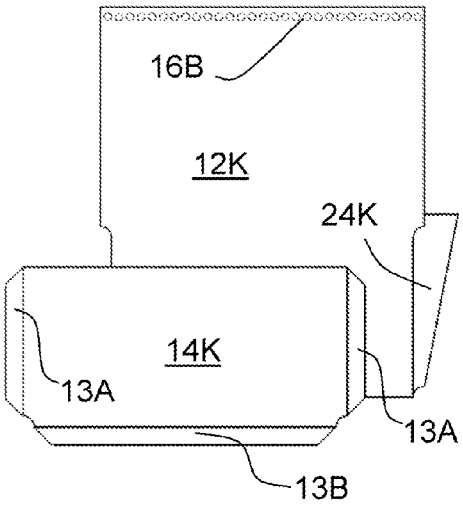

The embodiments of FIGS. 8A, 8B, 8C, 8D, 9A, 9B and 9C and 9D show a two-ply single major panel (such as panels 12C, 22C of FIG. 8A). However, instead of using two major panels, a single major panel (such as major panel 12B of FIG. 7B) may be used. For example, FIG. 9D illustrates a single major panel 12K joined to a back pocket panel 24K along their lower edge. A front pocket panel 14K is securable to the back pocket panel 24K via its flaps 13A, 13B. As can also be seen the major panel 12K includes cutouts along both its inner and outer edges, allowing for expansion of its associated pockets along two edges thereof. Thus, the expansion capabilities described and shown above can be utilized in the inner edge of the pocket/pocket divider, or the outer edge, or both edges (as shown in FIG. 9D)

Figure 10:
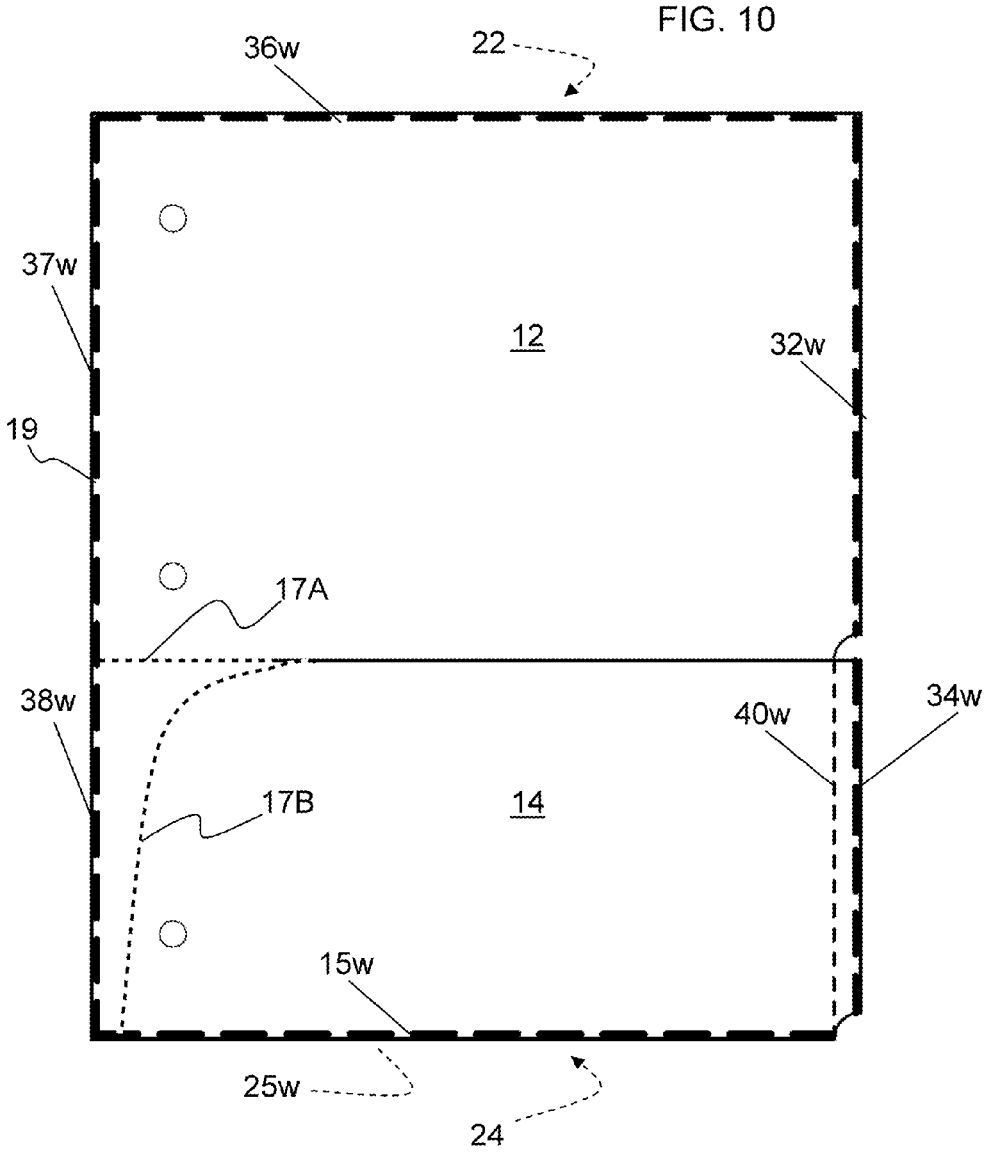
FIG. 10 is a front view of pocket divider illustrating various locations along which various portions of the pocket divider can be attached.

FIG. 10 illustrates examples of various joining locations when the pocket divider is made from more than one piece of material. For example front pocket panel 14 and back pocket panel 24 may be joined together along their outer or right edge along securing line 34*w*. Due to cutout 40, securing line 34*w* can avoid securing the pocket panels 14, 24 to the major panel(s) 12, 22. If two major panels 12, 22 are used, the outer edges of the major panels 12, 22 may be joined together along an upper portion of their outer edges along securing line 32*w*, and/or along a lower portion of their outer edges by securing line 40*w*.

The front pocket panel 14 and back pocket panel 24 may be joined together along their lower edge along a single securing line 15*w* which may also secure or join together front major panel 12 and back major panel 22. However, if the bottom of the major panel or panels 12, 22 stops short of the bottom of the pocket panels 14, 24, it may be possible to have securing line 15*w* join only the pocket panels 14, 24 and not the major panel or panels 22, 22. As another alternative securing line 15*w* may join the lower edges of front pocket panel 14 and front major panel 12, while securing line 25*w* may join the lower edges of back pocket panel 24 and back major panel 22.

If two major panels 12, 22 are used, their top edges may be joined along securing line 36*w*, and/or their left or inner edges 19 may be joined together along an upper portion by securing line 37*w* and/or along a lower portion by securing line 38*w*. Securing line 38*w* may join any of the panels 12, 14, 22, 24 along their lower inner or left edge. However in some cases it may be desired not to join pocket panel(s) 14, 24 by securing line 38*w*, in which case the inner or left edge of the pocket panels 14, 24 may stop short of that edge, and instead follow a path as shown as line 17B instead of following to the inner or left edge as with line 17A. This alternate configuration prevents the pocket panels 12, 14 from being joined along securing line 38*w*.

Figure 11A:
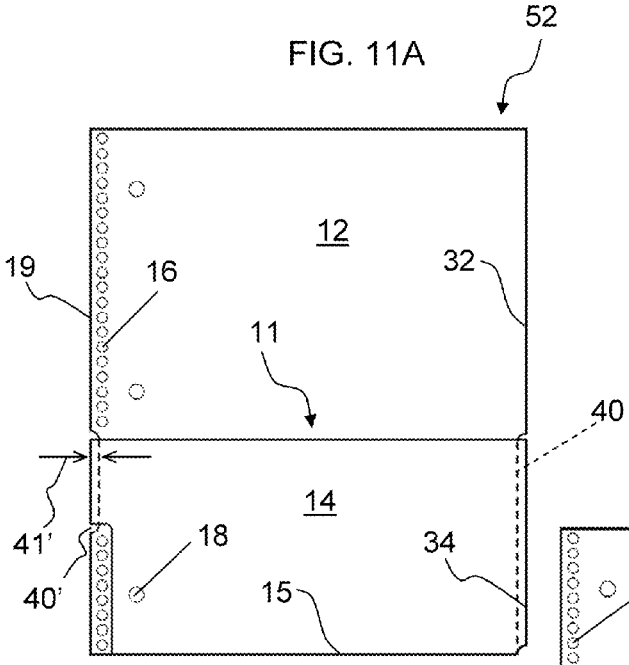
FIG. 11A is a front plan view of another embodiment of the pocket divider.
Figure 11B:
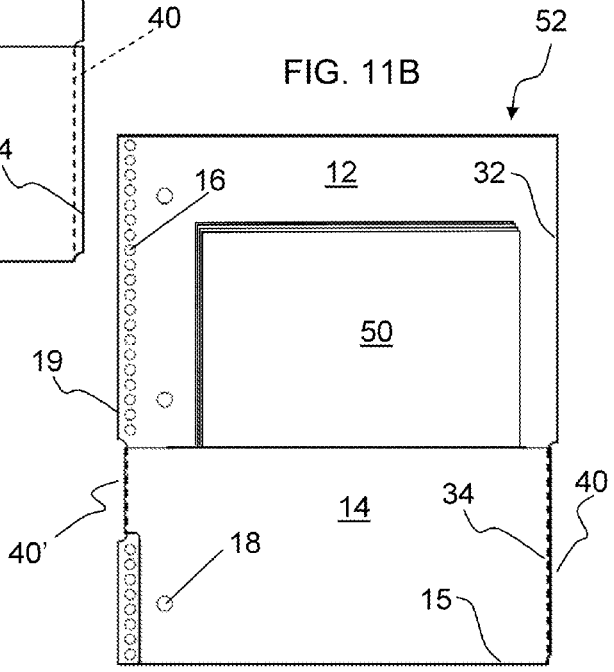
FIG. 11B is a front plan view of the pocket divider of FIG. 11A with items stored therein.

Many of the previous embodiments illustrate a pocket divider in which that right, or outer, edge of the pocket divider includes the cutout 40/gap 41. However, a cutout 40/gap 41, which provides the expansion features, can be positioned on either the right/outer 32/34 and/or left/inner 19 edges. For example, FIG. 9D, briefly described above, illustrates such expansion features on both edges of that pocket divider. FIG. 11A illustrates another embodiment in which a cutout 40' is positioned at or adjacent to the inner edge 19 of the pocket divider 52, defining a gap 41' between the outer edges of the pocket panels 14, 24 and the associated inner edge of the major panels 12, 22. If desired, a cutout 40/gap 41 can also be provided along the right/outer edges of the pocket divider 52. In this manner, when contents 50 are placed into the pocket 11, the pocket 11 expands in capacity due to closure/elimination of the gaps 41'/41 in the same or similar manner to that outlined above, providing double expansion capacity.

The cutout 40' can be formed at nearly any stage during formation of the pocket divider 52, including when the associated blank is unfolded, partially folded, or fully folded. In the embodiment of FIG. 11A the cutout 40' extends only part of the height of the pocket panel 14. Since the cutout 40' can remove some of the binding holes 16, it may therefore be desired to limit the amount of binding holes 16 that are removed so that the pocket divider 52 can be securely coupled to the binding mechanism 6. Moreover, in the illustrated embodiment the cutout 40' is formed at or adjacent to the upper edge of the pocket panels 14, 24 and/or spaced away from the lower edge. This configuration ensures that the binding holes 16 at the lower end of pocket divider 52 remain intact so that the lower edge of the pocket divider 52 is bound to the binding mechanism 6 to help retain the pocket divider 52 in place. However, if desired the cutout 40' can be positioned along the lower edge of the pocket panels 14, 24, which can provide greater expansion capacity, since the bottom corner of the pockets 11 can otherwise provide a pinch point. Thus, the cutout 40' can be positioned along any position along the sides of the pocket panels 14, 24, or along the entire height of a pocket panel 14, 24.

Figure 12A:
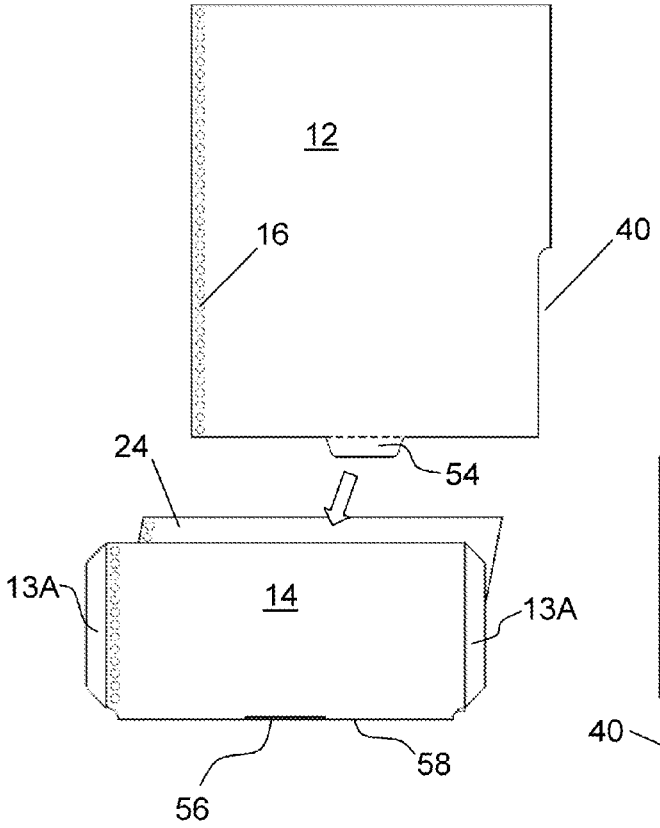
FIGS. 12A and 12B are front exploded views of various blanks that can be used to make pocket dividers.
Figure 12B:
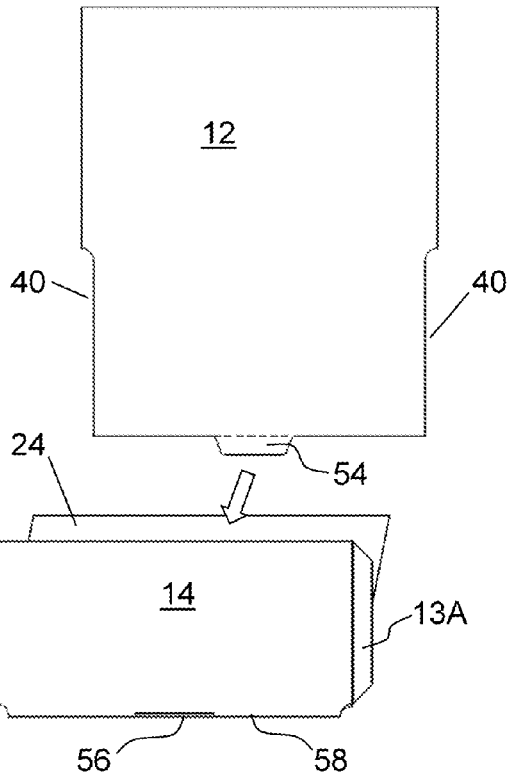

FIG. 12A illustrates another alternate embodiment in which case a single major panel 12 is secured to pocket panels 14, 24 that are joined along their common lower edges 58. The pocket panel 14 has a pair of securing flaps 13A protruding outwardly therefrom that can be utilized to secure the pocket panel 14 to the other pocket panel 24 and/or the major panel 12. Moreover, in this embodiment the major panel 12 has a securing tab 54 aligned with, and configured to fit through, a slot 56 formed along the fold line 58 separating the pocket panels 14, 24. The securing tab 54 can extend through the slot 56 and then be folded upwardly flat and secured against either pocket panel 14, 24 to aid in securing the major panel 12 in place. FIG. 12B illustrates another embodiment similar to that of FIG. 12A, except that the major panel 12 includes a cutout 40 formed on both lateral sides thereof, and the major panel 12 lacks the binder holes 16.

Figure 14A:
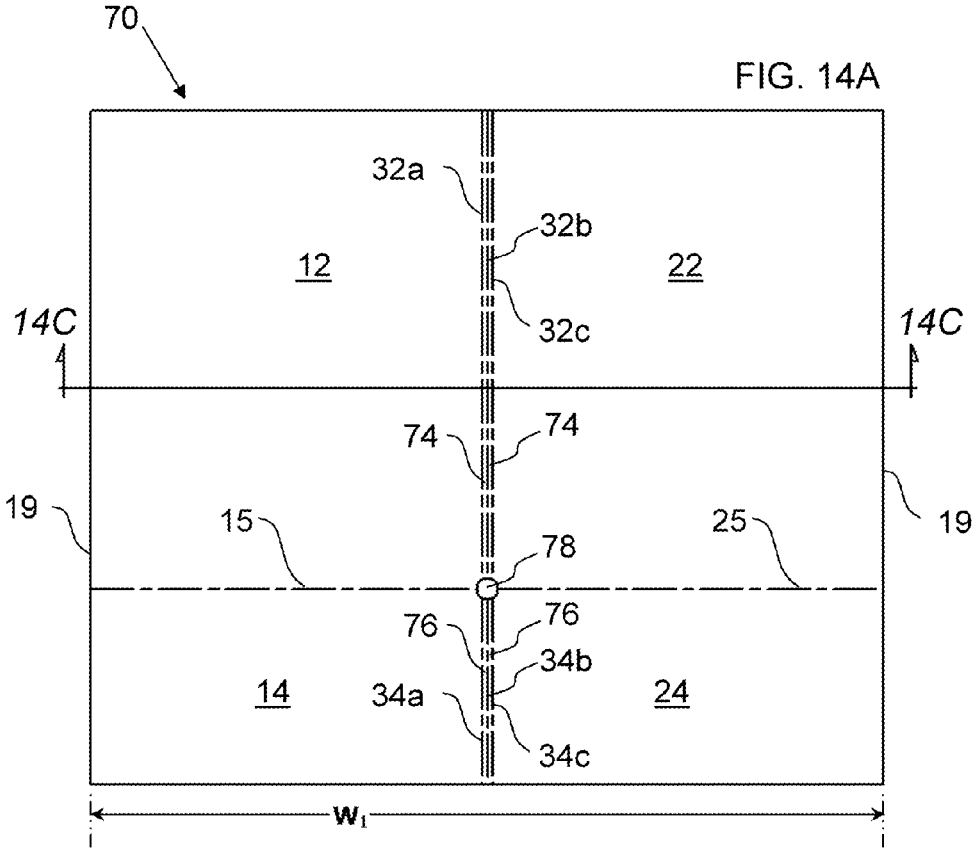
FIG. 14A is a top view of a blank that can be used to form a pocket divider.

FIG. 14A illustrates another blank 70 which can be used to form a pocket divider 72. In this case, rather than including only a single major vertical fold line 32, the blank 70 includes a set of three major vertical folds lines 32*a*, 32*b*, 32*c* positioned between the major panels 12, 22. Similarly, rather than including only a single minor/pocket vertical fold line 34, the blank 70 includes a set of three minor fold lines 34*a*, 34*b*, 34*c* positioned between the pocket panels 14, 24. The fold lines 32*a*, 32*b*, 32*c* define two folding panels 74 therebetween, and the fold lines 34*a*, 34*b*, 34*c* define two folding panels 76 therebetween. In this case the major panels 12, 22 and pocket panels 14, 24 can be considered to be coupled together along fold areas defined by the fold lines/panels. The blank 70 may include an opening 78 positioned at the intersection of the fold lines 15, 25, 32, 34, and the blank 70 may have a lateral width $w_1$.

Figure 14B:
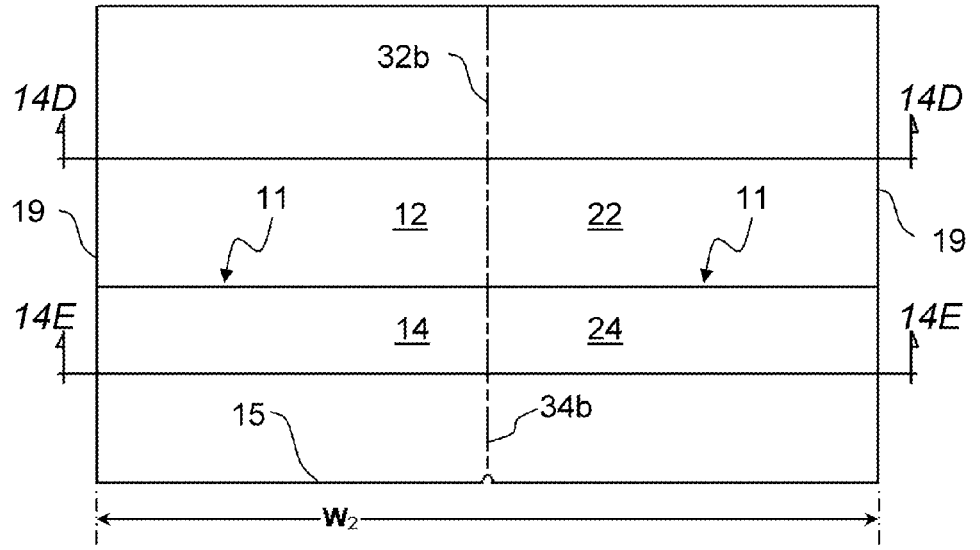
FIG. 14B is a top view of the blank of FIG. 14A, with the folding panels brought together and with the pocket panels folded up.

As shown in FIGS. 14B and 14D, in order to assemble the pocket divider 72, the blank 70 is folded about the fold lines 32*a*, 32*b*, 32*c* bringing the panels 74 into a generally parallel facially-abutting position. The blank 70 can also be simultaneously folded about fold lines 34*a*, 34*b*, 34*c*, bringing the panels 76 generally into facial abutment. The panels 74, 76 can extend either upwardly or downwardly from the plane of the blank 70, but in the illustrated embodiment extend downwardly, as shown in FIG. 14D. After the blank 70 is folded in this manner, the blank 70 has a lateral width $w_2$ that is less than the original lateral width $w_1$. Although not shown in the illustrated embodiment, if desired the panels 74 positioned between the major panels 12, 22 can be secured together in a facially abutting configuration.

After the blank 70 is folded about the fold lines 32*a*, 32*b*, 32*c*, 34*a*, 34*b*, 34*c*, the pocket panels 14, 24 are then folded about fold lines 15, 25, until the pocket panels 14, 24 are facing the associated major panel 12, 22, as shown in FIG. 14B. As can be seen in FIG. 14E, in this configuration the folded panels 76 of the pocket panels 14, 24 are positioned above the folded panels 74 of the major panels 12, 22, and extend in opposite directions.

Figure 15A:
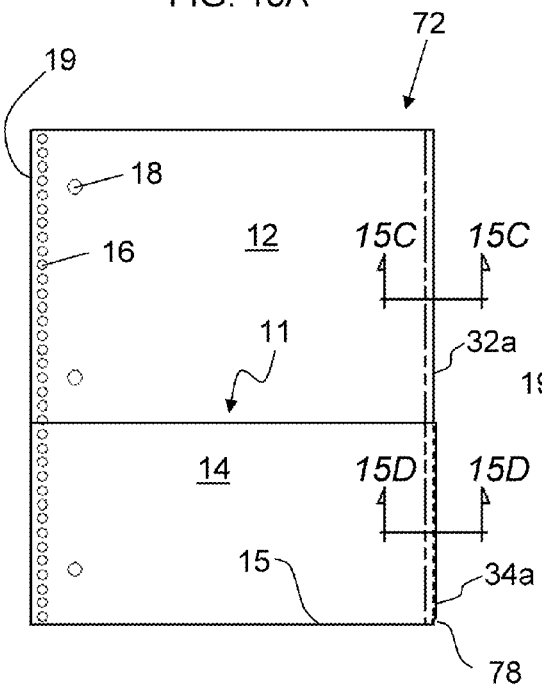
FIG. 15A is a top view of the blank of FIG. 14B after folding about its centerline, forming the pocket divider, with various holes formed therethrough, and shown in an expanded state.
Figure 15B:
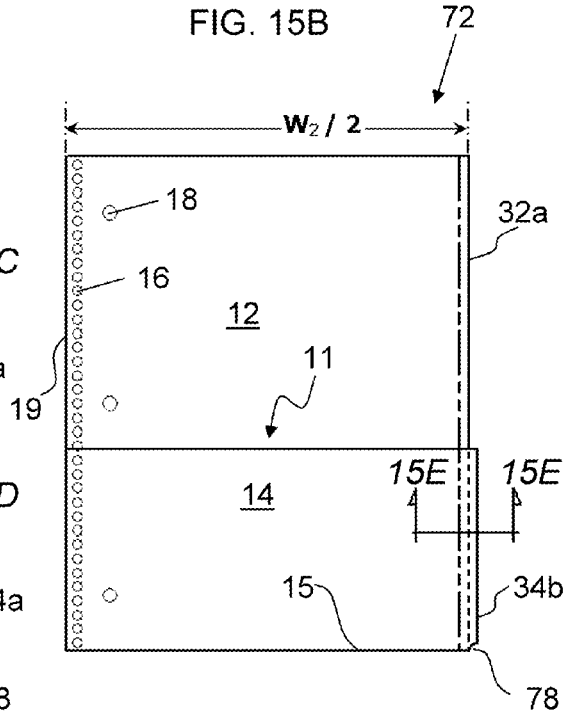
FIG. 15B is a top view of the pocket divider of FIG. 15A, shown in a collapsed state.
Figure 15C:
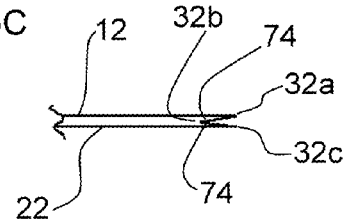
FIGS. 15C, 15D and 15E are cross sections taken along the lines indicated in FIGS. 15A and 15B.
Figure 15D:
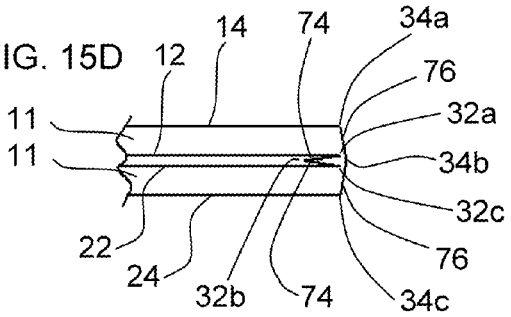
Figure 15E:
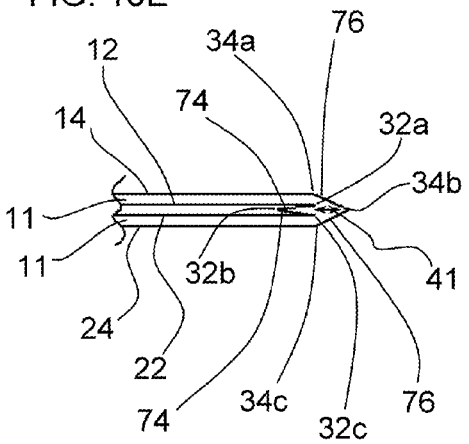

Once the blank 70 is formed into the configuration as shown in FIG. 14B, panels 12, 22 are folded about fold lines 32*b*, 34*b*, resulting in the pocket divider 72 shown in FIG. 15A. FIG. 15B illustrates the pocket divider 72 in its collapsed condition. As can be seen in FIG. 15E, the folding of the panels 74, 76 provides pockets 11 in which the major panels 12, 22 have a lesser lateral width than the lateral width of the pocket panels 14, 24. In this state a gap 41 is positioned between the outwardly-folded panels 76 of the pocket panels 14, 24 and the major panels 12, 22. The gap 41 provides expansion capability similar to that described above for other embodiments. In particular, as shown in FIGS. 15A and 15D, the pockets 11 can expand in capacity, moving the panels 76 to a position where the panels 76 are more perpendicular, or generally perpendicular, with respect to the major panels 12, 22/pocket panels 14, 24, such that the gap 41 is reduced or eliminated. When in the expanded state the pocket panels 14, 24 move away from the associated major panels 12, 22 in a perpendicular direction, providing increased capacity. When the additional capacity is no longer needed, the pockets 11 can be folded flat, moving the panels 76 to a position where the panels 76 are more parallel, or generally parallel, with respect to the panels 12, 14, 22, 24.

Figure 17A:
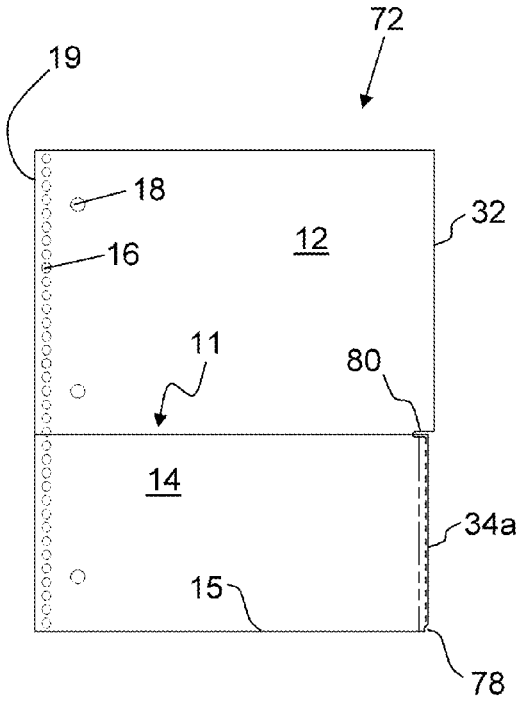
FIG. 17A is a top view of a pocket divider formed from the blank of FIG. 16, shown in an expanded state.
Figure 17B:
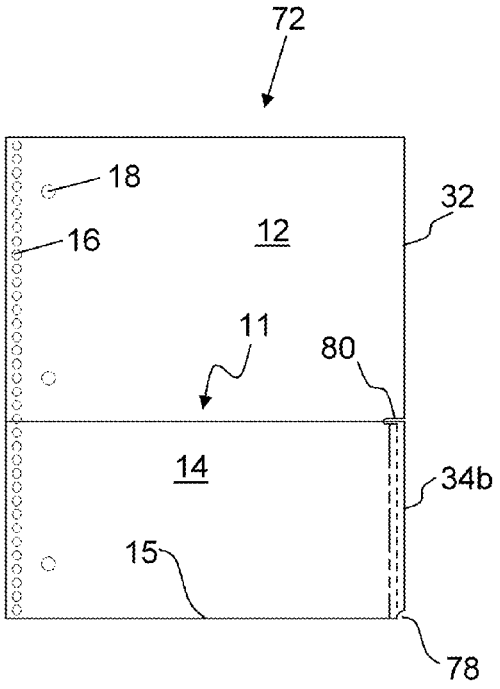
FIG. 17B is a top view of a pocket divider of FIG. 17A, shown in a collapsed state.
Figure 18A:
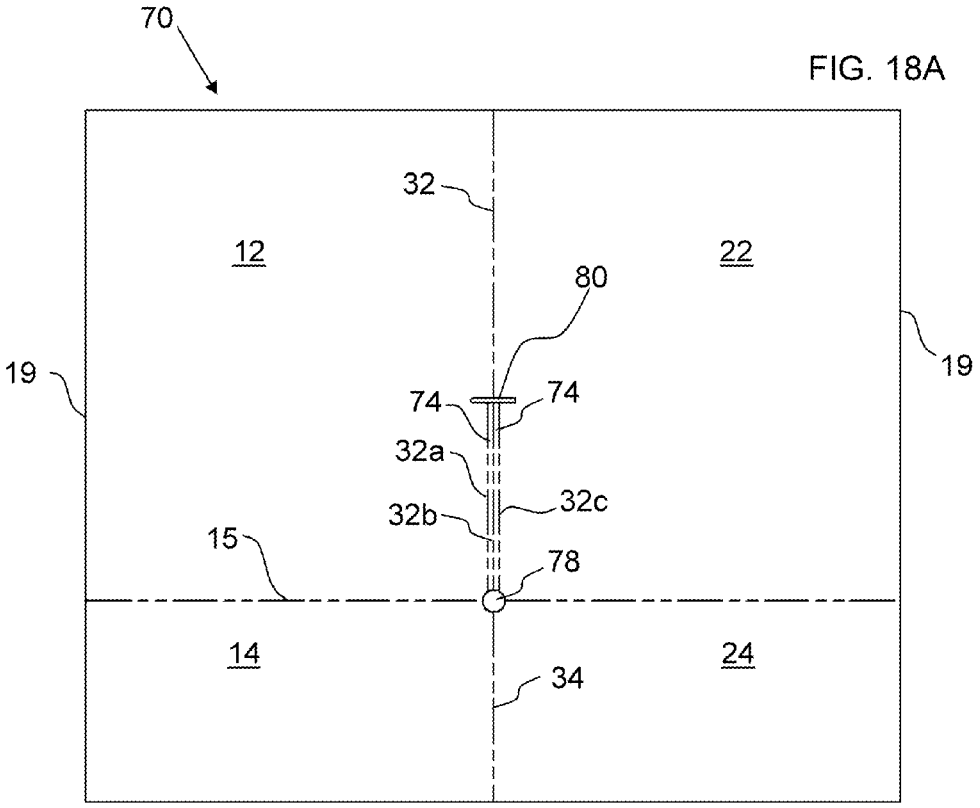
FIG. 18A is a top view of a blank that can be used to form a pocket divider.
Figure 18B:
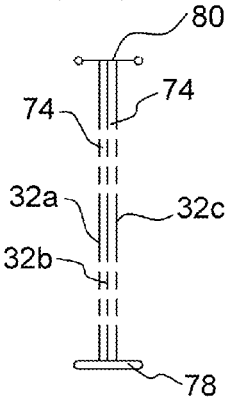
FIGS. 18B, 18C and 18D are top views of other arrangement that can be used in the blank of FIG. 18A.
Figure 18C:
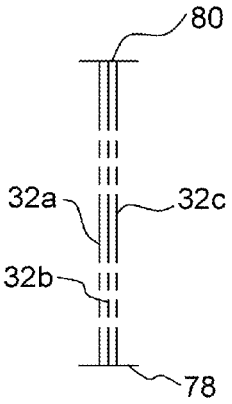
Figure 18D:
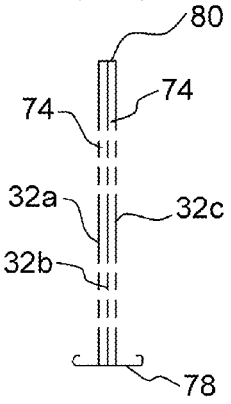
Figure 19A:
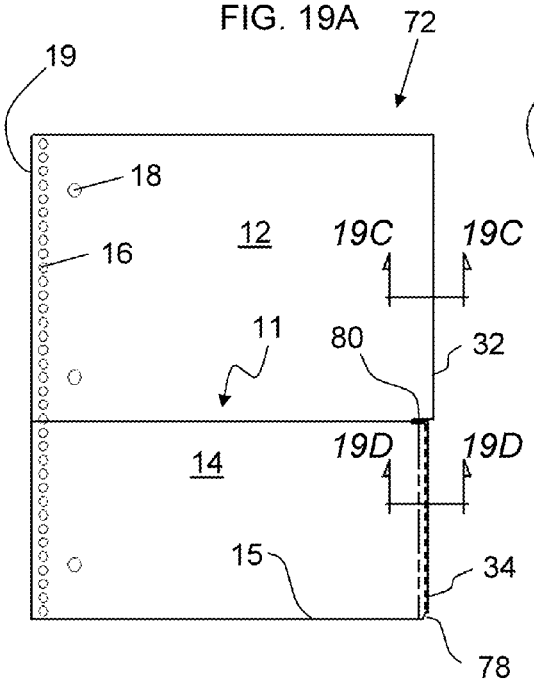
FIG. 19A is a top view of a pocket divider formed from the blank of FIG. 18A, shown in an expanded state.
Figure 19B:
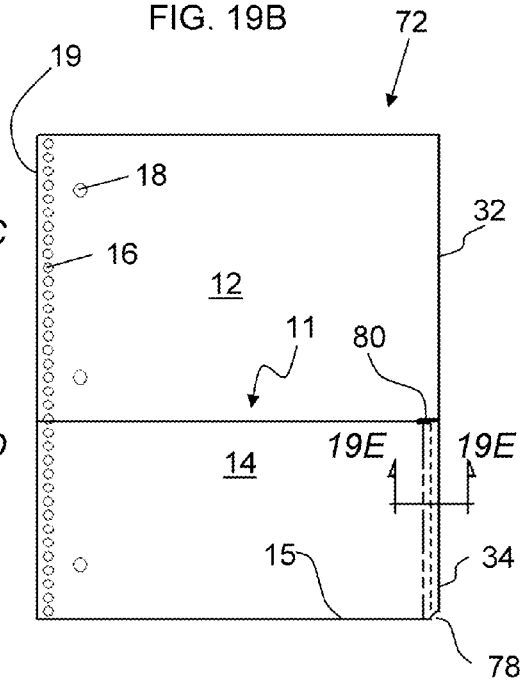
FIG. 19B is a top view of the pocket divider of FIG. 19A, shown in a collapsed state.
Figure 19C:
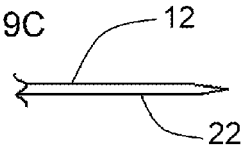
FIGS. 19C, 19D and 19E are cross sections taken along the lines indicated in FIGS. 19A and 19B.
Figure 19D:
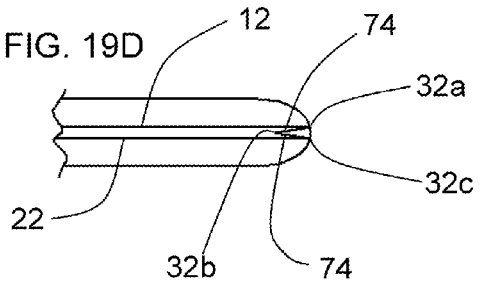
Figure 19E:
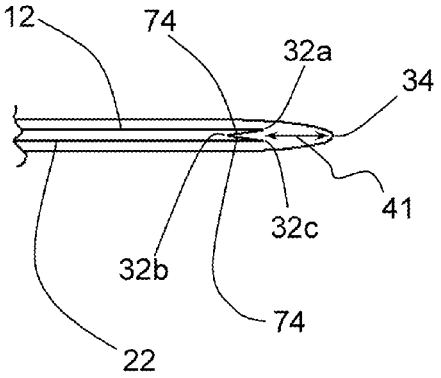

FIGS. 16, 17A and 17B illustrate another embodiment similar to that of FIGS. 14 and 15. However, in the embodiment of FIGS. 16, 17A and 17B the fold lines 32*a*, 32*b*, 32*c*/panels 74 do not extend the entire height of the major panels 12, 22, and instead are positioned only in the bottom portion thereof, having a height generally equal to or greater than the height of the pocket panels 14, 24. In this embodiment the blank 70 may include an opening or cutout in the form of a stress relief feature 80 at the distal end of the fold lines 32*a*, 32*b*, 32*c*/panels 74. The stress relief feature 80 enables the panels 74 to be folded about the fold lines 32*a*, 32*b*, 32*c*, reducing the effective width of the major panels 12, 22 in that area to provide the gap 41 in the same manner as shown in FIG. 15E. Once the pocket divider 72 is formed, as shown in FIGS. 17A and 17B, the pocket divider 72 has expansion capabilities similar to those described above in the context of FIGS. 14 and 15. The embodiment of FIGS. 16, 17A, 17B provides folding/panels 74 only where needed, but the embodiment of FIGS. 14 and 15 may provide ease of manufacturing.

FIGS. 18-19 illustrate an additional embodiment similar to that of FIGS. 16 and 17. However, in the embodiment of FIGS. 18-19, the fold lines 34*a*, 34*c*/panels 74 are not provided on the pocket panels 14, 24, and an opening 78 and stress relief 80 are positioned at either end of the fold line 32/panels 74 to enable the panels 74 to be folded in the manner outlined above. Once the pocket divider 72 is formed from the blank 70 of FIG. 18A, as shown in FIGS. 19A and 19B, the pocket divider 72 has expansion capabilities as described above in the context of FIGS. 14 and 15. However, because pocket panels 14, 24 lack the defined fold lines 34*a*, 34*b*, 34*c* the outer edges of the pockets 11 have more of a rounded shape when in the expanded state, as shown in FIG. 19D, and therefore may have a lesser capacity than the pocket of FIGS. 16 and 17. The blank 70 shown in FIG. 18A is somewhat similar in function to the blank 1 of FIG. 1, in that the opening 80, stress relief 78 and fold lines 32*a*, 32*b*, 32*c* of FIG. 18A enable the lateral dimension of the blank 70 to be reduced, providing features analogous to the cutout 40 of FIG. 1.

Having described the invention in detail and by reference to the various embodiments, it should be understood that modifications and variations thereof are possible without departing from the scope of the claims of the present application.

What is claimed is:

1. A pocket device, comprising:

a major panel having a front major panel, a back major panel, and a corresponding lateral dimension; and a pocket panel having a front pocket panel and a back pocket panel, said front pocket panel coupled to said front major panel and defining a front pocket with said front major panel, said back pocket panel being coupled to said back major panel and defining a back pocket with said back major panel, wherein said pocket panel defines a fold line extending between said front pocket panel and said back pocket panel that is positioned along an outermost edge of said pocket device when folded in a closed position, wherein a lateral dimension of said pocket panel is greater than said corresponding lateral dimension of said major panel to define a laterally-extending gap therebetween that extends along an entire height of said pocket panel along said outermost edge of said pocket device when folded in a closed position, said laterally-extending gap positioned relative to said fold line such that said fold line is pulled inwards to enable expansion of at least one of said pockets based on content being placed within said pocket panel, said height of said pocket panel being generally perpendicular to said lateral dimension.

2. The pocket device of claim 1 wherein said front pocket panel is oriented generally parallel with and facing said major panel to define said front pocket, said front pocket having a mouth, and wherein said gap extends in a lateral direction generally parallel to said mouth.

3. The pocket device of claim 1 wherein said major panel and said pocket panel are coupled together along a binding edge, and wherein said gap is positioned on an opposite side of said pocket device relative to said binding edge.

4. The pocket device of claim 1 wherein said pocket device is configured such that a volume of at least one of said pockets increases as a lateral dimension of said gap decreases due to movement of said pocket panel.

5. The pocket device of claim 1 wherein said lateral dimension of said pocket panel is greater than said corresponding lateral dimension of said major panel due to the gap being a cutout in said major panel.

6. The pocket device of claim 1 wherein said major panel and said pocket panel are formed of a single unitary piece of material and are coupled along a pocket fold line positioned along a bottom of at least one of said pockets.

7. The pocket device of claim 1 wherein said gap is positioned adjacent to and generally aligned with a major fold line or area.

8. A pocket device comprising:

a first major panel and a second major panel coupled together along a fold line;

a first pocket panel coupled to said first major panel along a first pocket fold line and defining a first pocket with said first major panel; and a second pocket panel coupled to said second major panel along a second pocket fold line and defining a second pocket with said second major panel, wherein said first pocket panel and said second pocket panel are coupled together at an outermost fold line positioned along an outermost edge of said pocket device when folded in a closed position, and wherein each pocket panel has a lateral dimension greater than a lateral dimension of the associated major panel at at least a distal end of said pocket panel positioned opposite the associated pocket fold line to thereby define a lateral gap therebetween, said lateral gap disposed along said outermost edge of said pocket device when folded in a closed position having a greater height than said first pocket panel and said second pocket panel, said laterally-extending gap positioned relative to said outermost fold line such that said outermost fold line is pulled inwards to enable expansion of said first and second pockets based on content being placed within at least one of said first pocket panel and said second pocket panel.

9. A pocket device comprising:

a major panel having a front major panel, a back major panel, and a corresponding lateral dimension; and a pocket panel having a front pocket panel and a back pocket panel, said front pocket panel coupled to said front major panel along a pocket fold line and defining a front pocket with said front major panel, said back pocket panel being coupled to said back major panel along said pocket fold line and defining a back pocket, wherein said pocket panel defines a second fold line extending between said front pocket panel and said back pocket panel and positioned along an outermost edge of said pocket device, wherein said pocket panel has a lateral dimension greater than said corresponding lateral dimension of said major panel at least at a distal end of said pocket panel positioned opposite said pocket fold line to thereby define a lateral-extending gap therebetween that has a height greater than said pocket panel, said laterally-extending gap extending along said outermost edge of said pocket device and positioned relative to said second fold line such that said second fold line is pulled inwards to thereby enable expansion of at least one of said pockets based on content being placed within said pocket panel.

* * * * *